US006867743B2

(12) United States Patent
Schadler

(10) Patent No.: US 6,867,743 B2
(45) Date of Patent: Mar. 15, 2005

(54) SLOTTED ANTENNA SYSTEM AND METHOD

(75) Inventor: John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 2 days.

(21) Appl. No.: 10/417,237

(22) Filed: Apr. 17, 2003

(65) Prior Publication Data

US 2004/0207562 A1 Oct. 21, 2004

(51) Int. Cl.[7] ..... H01Q 13/10
(52) U.S. Cl. ..... 343/767; 343/770

(58) Field of Search ..... 343/767

(56) References Cited

U.S. PATENT DOCUMENTS 6,703,984 B2 * 3/2004 Schadler ..... 343/770

* cited by examiner

*Primary Examiner*—James Vannucci
(74) *Attorney, Agent, or Firm*—Baker & Hostetler LLP

(57) ABSTRACT

A directional antenna is disclosed that includes an inner conductor positioned within an outer conductor. The directional antenna includes multiple slots around the periphery of the antenna and efficiently dissipates energy received at the slot, and is able to generate a directional azimuth pattern.

20 Claims, 4 Drawing Sheets

SLOTTED ANTENNA SYSTEM AND METHOD

FIELD OF THE INVENTION

The present invention relates generally to antenna systems. More particularly, the present invention is directed to a high power directional slotted coaxial antenna and method.

BACKGROUND OF THE INVENTION

There are a number of stations that have been assigned a pair of channels, consisting of one National Television System Committee (NTSC) channel and one digital (DTV) channel, that require the station to transmit both NTSC and DTV channels at their maximum effective radiation power (ERP), for example, 5 megawatt (MW) for NTSC channels and 1 MW for DTV channels.

Often, it is an objective to direct transmission of NTSC and DTV signals in a particular direction. Conventionally, single-slot coaxial antennas, which have a single slot cut into the wall of the antenna, are utilized to transmit directional signals. When directional signals are transmitted, the majority of signal power is transmitted in one direction, and "skull" or "cardioid" shaped azimuth patterns are generated.

However, conventional single-slot antennas are at least sometimes not successful in transmitting high power signals, in particular, two high power channels, such as a 5 MW NTSC channel and a 1 MW DTV channel, at the same time. Conventional single-slot antennas are at least sometimes unable to adequately dissipate the amount of energy that is attributed to the pair of channels.

"Q" is a ratio that characterizes the amount of energy that is stored at a slot of an antenna versus the amount of energy that is dissipated by the slot. Ideally, an antenna operates more efficiently when it avoids the storing of energy. Typically, the higher the "Q" of a slot, the less power the slot of the antenna is able to handle. If the amount of energy stored at a slot becomes excessive, the air between the slot may begin to ionize, and the slot may function improperly.

It is known in the art that coaxial antennas with multiple slots have a lower "Q" per slot. In general, the more slots cut into a coaxial wall of an antenna layer, the more the antenna is able to dissipate the energy it receives. However, coaxial antennas with multiple slots have traditionally been utilized to generate omni-directional azimuth patterns. When more than one slot is cut into a layer of conventional coaxial antenna, the coaxial antenna will transmit energy, substantially evenly, in more than one direction. While conventional multiple-slotted coaxial antennas are successful in reducing the "Q" of an antenna, they have generally not been successful in transmitting directional signals.

Accordingly, it would be desirable to provide an antenna that avoids at least to some extent the storing of energy at a slot.

It would also be desirable to provide an antenna that is capable of transmitting high power NTSC and DTV channels simultaneously.

It would also be desirable to provide a directional slotted antenna.

SUMMARY OF THE INVENTION

The foregoing needs are met, to a great extent, by the present invention, wherein in one aspect an apparatus and method is provided that in some embodiments provides a slotted antenna that is capable of transmitting high power NTSC and DTV channels simultaneously, and that at least to some degree avoids the storing of energy at a slot.

In one aspect of the present invention, a directional slotted antenna is provided that includes an outer conductor, and inner conductor positioned within the outer conductor, and a first slot and a second slot positioned around a peripheral of the outer conductor. The first slot and the second slot form a first layer of the slotted antenna. Energy transmitted due to the first slot and the second slot generates a directional azimuth pattern from the directional slotted antenna.

In another aspect of the present invention, a method of assembling a directional antenna that includes positioning an inner conductor within an outer conductor, and positioning a first and second slot around a periphery of the outer conductor on a first layer of the directional antenna.

In another aspect of the present invention a directional slotted antenna system is provided that includes a means for feeding a signal to a first slot, a means for coupling the signal from the feeding means to the first slot, and a means for establishing a first potential difference across the first slot and a second potential difference across a second slot, such that a directional azimuth pattern is generated from the directional antenna system.

In yet another aspect of the present invention a directional slotted antenna is provided that includes an outer conductor and a first slot and a second slot positioned around the peripheral of the outer conductor. The directional slotted antenna generates a directional azimuth pattern.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
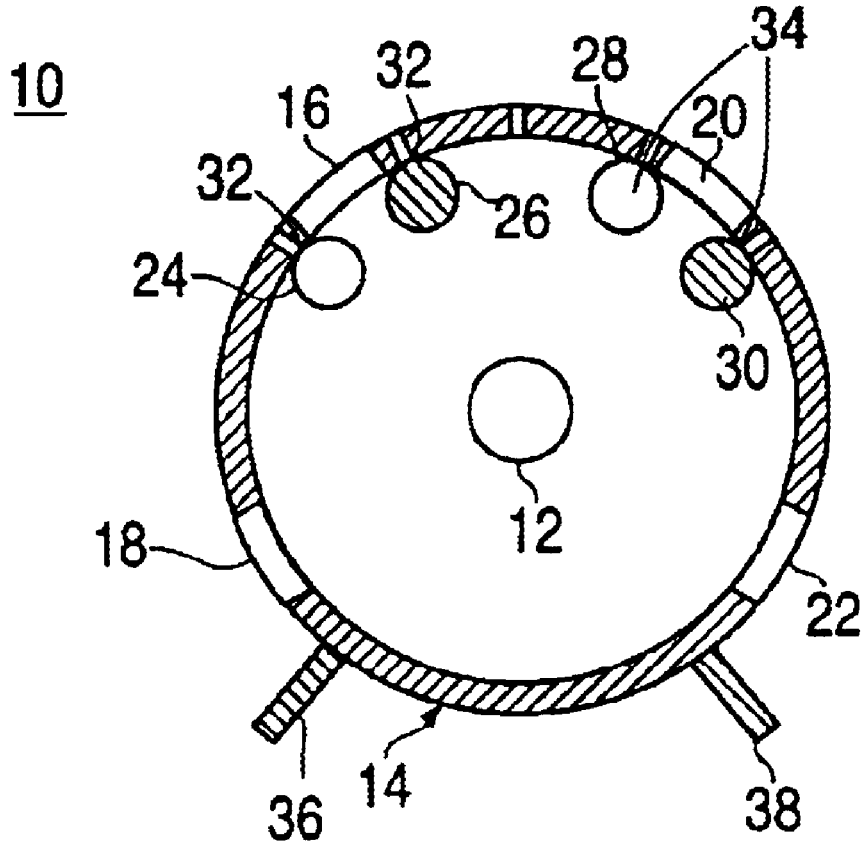
FIG. 1 is a cross-sectional view of a slotted coaxial antenna in accordance with the present invention, taken through line 1—1 in FIG. 2.

The invention in some embodiments provides a slotted antenna that is capable of transmitting high power NTSC and DTV channels simultaneously, and that at least to some degree avoids the storing of energy at a slot. The invention will be described with reference to the drawing figures, in which like reference numerals refer to like parts throughout. One embodiment of the present invention provides a multi-slotted antenna having an inner conductor positioned within an outer conductor, and a first slot and a second slot positioned around the peripheral of the outer conductor that form a first layer of the antenna. When energy is transmitted from the multi-slotted antenna, due to the first and second slots, a directional azimuth pattern is generated from the multi-slotted antenna.

The multi-slotted antenna may be utilized to transmit directional signals, and is capable of transmitting high power signals, for example, a 5 MW NTSC channel and a 1 MW DTV channel simultaneously. Moreover, the multi-slotted antenna of the present invention efficiently stores and dissipates energy at a slot.

Shown in FIG. 1 is a cross-sectional view of a multi-slotted antenna 10, in accordance with the present invention. The design of the antenna 10 includes an inner conductor 12 positioned within an outer conductor 14. Multiple slots 16, 18, 20 and 22 are positioned around the peripheral of the outer conductor 14. In a preferred embodiment of the present invention, the inner conductor 12 and the outer conductor 14 are coaxial, and there are four slots 16, 18, 20 and 22 for each layer of the antenna 10.

Two of the slots, slots 16 and 20, are directly coupled slots that are referred to as non-parasitic slots. Slot 16 is directly coupled via couplers 24 and 26, and slot 20 is directly coupled via couplers 28 and 30. The other two of the slots, slots 18 and 22, are indirectly coupled slots and are referred to as parasitic slots. Slot 18 is indirectly coupled via couplers 24 and 26, and slot 22 is indirectly coupled via couplers 28 and 30. Each of the non-parasitic slots have one of couplers 24–30 positioned at each end of the respective slots, and first and second coupler pairs 32, 34 are formed. The parasitic slots 18 and 22 do not have a coupler positioned immediately at each end. Fins 36, 38 are coupled to the outer conductor 14.

Figure 2:
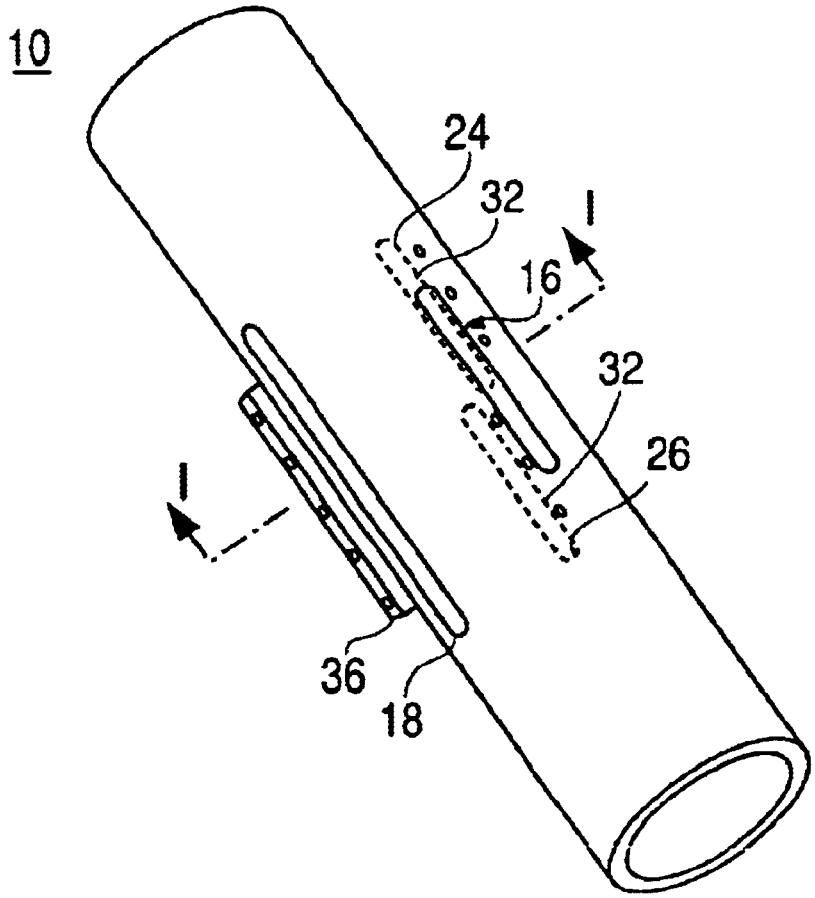
FIG. 2 is a perspective view of the slotted coaxial antenna of FIG. 1.

FIG. 2 is a perspective view of one layer of antenna 10. As shown in FIG. 2, one coupler 24 of the coupler pair 32 is positioned at a height along a y-axis that is above the other coupler 26, such that a potential difference across the slot 16 is created.

During operation, the couplers 24, 26, 28 and 30 couple the signal power from the inner conductor 12 to the outer conductor 14. The first coupler pair 32 creates a first potential difference across the first non-parasitic slot 16 and a second potential difference across the first parasitic slot 18.

The potential differences established across slots 16 and 18 cause currents to radiate from the outer conductor 14. However, the current generated due to the first parasitic slot 18 will be less than the current generated due to the first non-parasitic slot 16, as the couplers 24, 26 of the coupler pair 32 are further from the ends of the parasitic slot 18. As a result, the second potential difference across the parasitic slot 18 is less than the first potential difference across the non-parasitic slot 16. It should be understood that the first coupler pair 32 may create a potential difference across slots 20 and 22. However, the effect of the potential difference on the resulting azimuth pattern is minimal in some embodiments.

Similarly, the second coupler pair 34 creates a third potential difference across the second non-parasitic slot 20 and a fourth potential difference across the second parasitic slot 22. The potential differences established across slots 20 and 22 cause currents to radiate from the outer conductor 14. However, the current generated due to the second parasitic slot 22 is less than the current generated due to the second non-parasitic slot 20, as the couplers 28, 30 of the second coupler pair 34 are further from the ends of the parasitic slot 22. As a result, the potential difference across the parasitic slot 22 is less than the potential difference across the non-parasitic slot 20. It should be understood that the second coupler pair 34 may also create a potential difference across slots 16 and 18. However, the effect of the potential difference on the resulting azimuth pattern is minimal in some embodiments.

Unlike a conventional multi-slotted antenna that only transmits omni-directional signals, an antenna in accordance with the present invention is a multi-slotted antenna that may be utilized to transmit directional signals. Accordingly, an antenna 10 in accordance with the present invention is able to generate a "cardioid" or "skull" shaped azimuth pattern that is indicative of the transmission of directional signals.

In addition, the use of directly and indirectly coupled slots also referred to herein as non-parasitic and parasitic slots, respectively, accomplishes proportional distribution of the coupled signal power between slots 16 and 18 and also, between slots 20 and 22.

As a result, the distribution of the signal power that is transmitted from the antenna is controlled. Thus, more signal power is transmitted from the non-parasitic slots 16, 20 due to the greater currents generated by the non-parasitic slots 16, 20, than the parasitic slots 18, 22. Accordingly, a directional azimuth pattern, where more energy is distributed in one direction than another, is generated from that layer of the antenna 10.

The fins 36, 38 may also be utilized to shape the resulting azimuth pattern. A directional azimuth pattern may also be shaped by selecting, for example, the coupler sizes, the number of slots, the size of the slots, the length of the slots, the positioning of the parasitic slots, and/or the positioning of fins that are positioned around the peripheral of the outer conductor.

Moreover, the antenna in accordance with the present invention, while benefiting from the ability of a multi-slot configuration to distribute energy among more than one slot can avoid the generation of an omni-directional azimuth pattern and produce a directional azimuth pattern. Accordingly, the antenna in accordance with the present invention, avoids the storing of energy at one slot and reduces the "Q" associated with a single-slot antenna.

Figure 3:
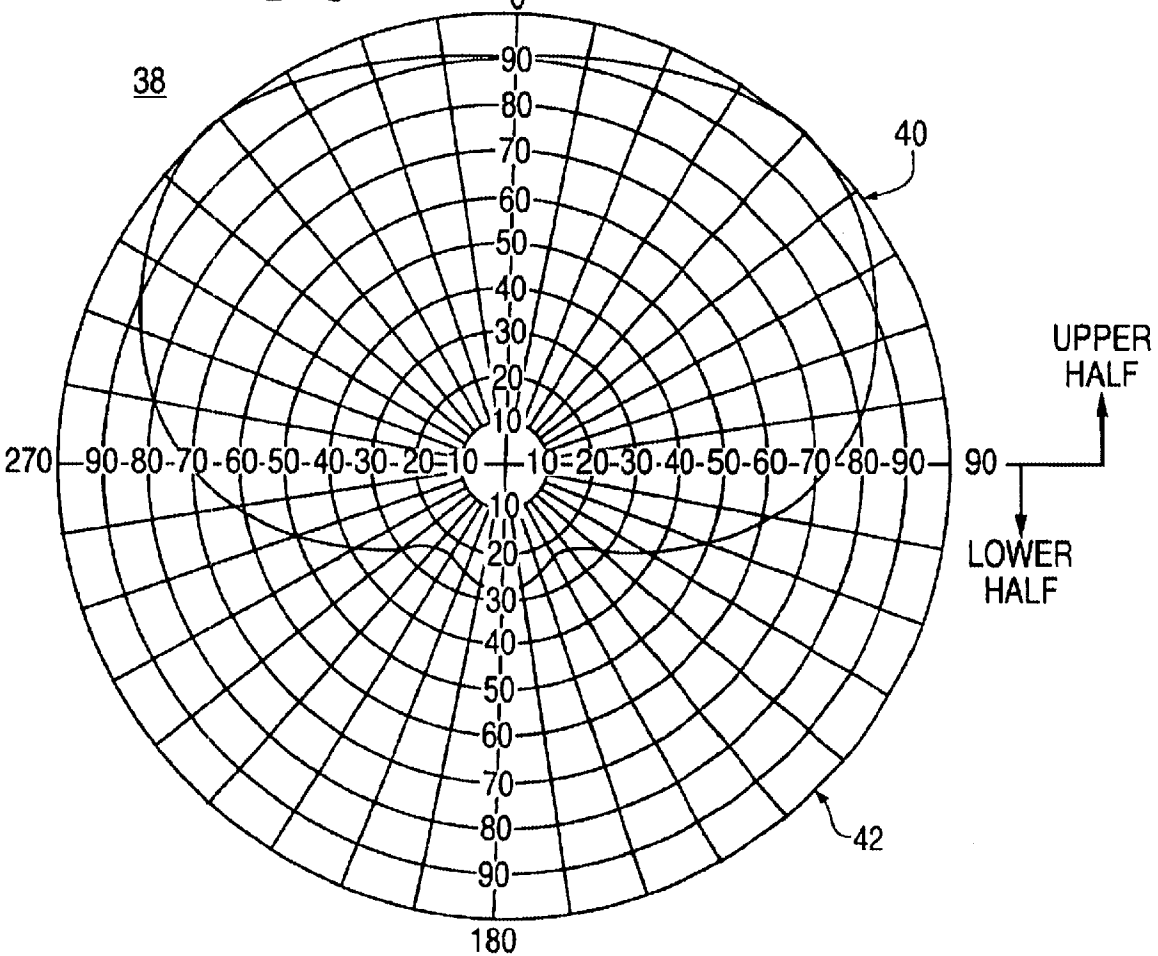
FIG. 3 is a graphical representation of a cardioid-shaped azimuth pattern.

Shown in FIG. 3 is a directional azimuth pattern 38 generated from an antenna 10 in accordance with the present invention. As shown in FIG. 3, the proportion of the energy distributed in the upper half 40 of the azimuth pattern 38, which, in this example, corresponds to the location of the directly coupled, non-parasitic slots 16, 20, is greater than the proportion of the energy distributed in the lower half 42 of the azimuth pattern 38, which corresponds to the indirectly coupled, parasitic slots 18, 22.

Advantageously, the proportional distribution of energy between the non-parasitic slots 16, 20 and their corresponding parasitic slot 18, 22 remains constant for each layer of an antenna 10 having the same non-parasitic and parasitic slot configuration. As a result, the proportion of signal power transmitted from layer to layer stays the same and a directional azimuth pattern 38 can be maintained for each layer of the antenna. Thus, if the antenna requires an adjustment with the amount of energy that is coupled to the outer conductor 14, for example, to accomplish beam tilting, the proportion of signal power transmitted will remain equal, as long as the length of the parasitic slots remain equal for each layer of the antenna 10. The length of the parasitic slots do not have to be equal to each other, but have to be equal to the corresponding parasitic slot of another layer, which is in the same position relative to the periphery of the outer conductor 14, to maintain a directional azimuth pattern with an equal radiation ratio for each layer of the antenna. Accordingly, a directional azimuth pattern 38 will be generated for each layer of the antenna 10. The desired radiation ratio will remain equal and independent of the size of couplers 24, 26, 28 and 30 or the slot length of the non-parasitic slots 18, 20.

In a preferred embodiment of the present invention, the amount of signal power transmitted due to the parasitic slots 18, 22 is one-fourth of the amount of signal power transmitted due to the non-parasitic slots 16, 20. However, other ratios can alternatively be employed.

Figure 4:
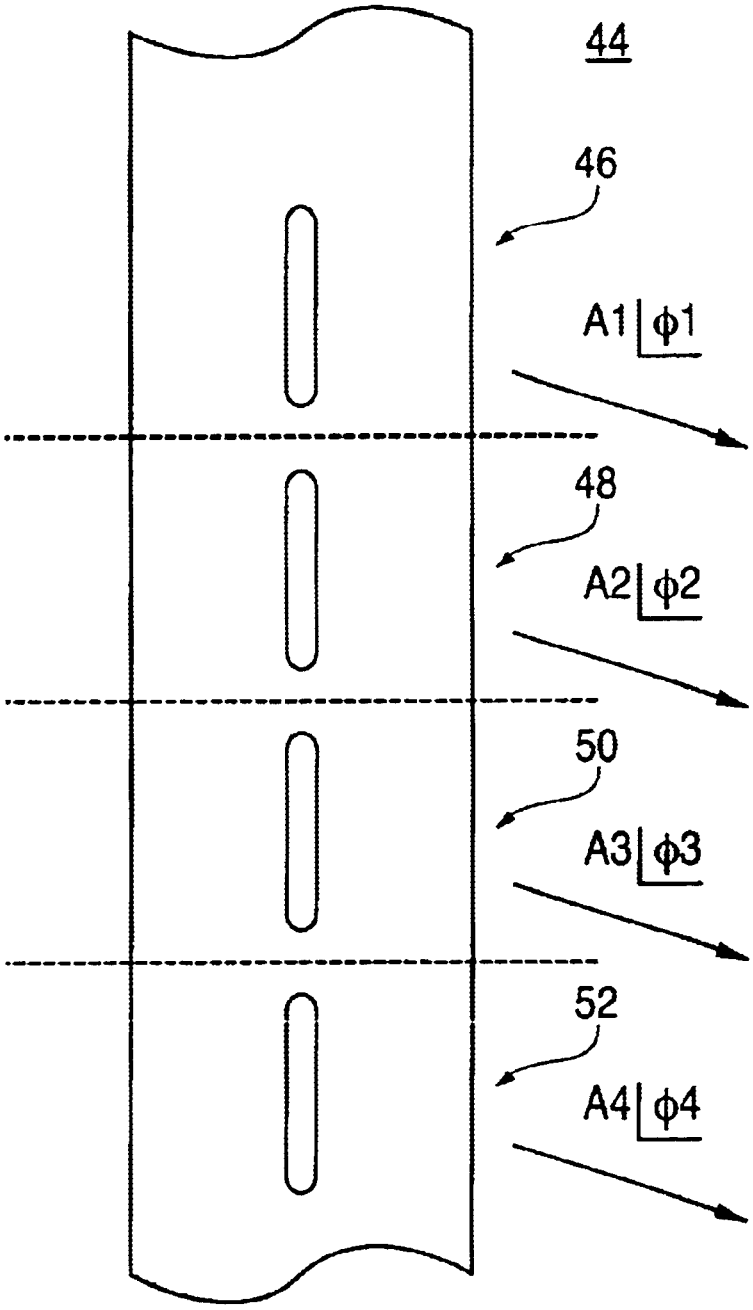
FIG. 4 is a multi-layer slotted coaxial antenna in accordance with the present invention.

Shown in FIG. 4 is an embodiment of a multi-layer slotted coaxial antenna 44 in accordance with the present invention. The slotted coaxial antenna of FIG. 4 has a first layer 46, a second layer 48, a third layer 50, and a fourth layer 52. Each layer may transmit signals that have different amplitudes and phases to shape a desired elevation pattern for the antenna. It is not uncommon to vary the size of the couplers at the directly coupled slots or the slot length of the directly coupled slots to vary the amplitude and phase of a signal transmitted from each layer of an antenna. However, as long as the length of a parasitic slot remains equal to the length of a parasitic slot of other layers 46, 48, 50, 52 that are in the same position relative to the periphery of the outer conductor 14 of the antenna 44, a directional azimuth pattern will be generated for each layer 46, 48, 50, 52 of the antenna 44, and the radiation ratio will be the same, or substantially the same, for each layer 46, 48, 50, 52 of the antenna 44.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A directional slotted antenna, comprising:

an outer conductor;

an inner conductor positioned within the outer conductor; and a first directly coupled slot and a second parasitic slot positioned around a periphery of the outer conductor forming a first layer of the directional slotted antenna, wherein energy transmitted via the first slot and the second slot generates a directional azimuth pattern from the directional slotted antenna.

2. The antenna of claim 1, further comprising a fin coupled to the outer conductor.

3. The antenna of claim 1, wherein the directional slotted antenna transmits an NTSC and a DTV channel simultaneously.

4. The antenna of claim 3, wherein the NTSC channel is a 5 MW channel and the DTV channel is a 1 MW channel.

5. The antenna of claim 1, further comprising:

a first coupler positioned at a first end of the first slot; and a second coupler positioned at a second end of the first slot.

6. The antenna of claim 5, wherein the first coupler and the second coupler couple energy from the inner conductor to the first slot and establishes a first potential difference across the first slot, and a second potential difference across the second slot that is less than the potential difference across the first slot.

7. The antenna of claim 5, wherein a bottom of the first coupler is positioned at a height on a y-axis that is greater than a position along the y-axis of a top of the second coupler.

8. The antenna of claim 5, wherein a first length of the second slot determines the proportion of energy coupled to the second slot.

9. The antenna of claim 5, wherein a ratio of radiated power between the first slot and second slot is equal.

10. The antenna of claim 5, further comprising:

a third slot and a fourth slot positioned around the peripheral of the outer conductor.

11. The antenna of claim 10, further comprising:

a third coupler positioned at a first end of the third slot; and a fourth coupler positioned at a second end of the third slot.

12. The antenna of claim 11, wherein the third coupler and the fourth coupler couple energy from the inner conductor to the third slot, and establishes a third potential difference across the third slot, and a fourth potential difference across the fourth slot that is less than the potential difference across the third slot.

13. A method of assembling a directional antenna, comprising:

positioning an inner conductor within an outer conductor; and positioning a first directly coupled slot and second parasitic slot around a periphery of the outer conductor on a first layer of the directional antenna.

14. The method of claim 13, further comprising controlling a first ratio of radiated power between the first slot and the second slot according to a slot length of the second slot.

15. The method of claim 13, further comprising:

positioning a first coupler at a first end of the first slot; and positioning a second coupler at a second end of the first slot.

16. The method of claim 13, further comprising:

positioning a third slot and a fourth slot around the periphery of the first layer.

17. The method of claim 16, further comprising:

positioning a third coupler at a first end of the third slot; and positioning a fourth coupler at a second end of the third slot.

18. The method of claim 13, further comprising forming a second layer of the directional antenna by positioning a fifth slot and a sixth slot around the peripheral of the outer conductor.

19. The method of claim 18, wherein a second ratio of radiated power between the fifth slot and the sixth slot equals the first ratio of radiated power.

20. A directional antenna system, comprising:

means for feeding a signal to a first directly coupled slot; and means for coupling the signal from the feeding means to the first slot; and means for establishing a first potential difference across the first slot and a second potential difference across a second parasitic slot such that a directional azimuth pattern is generated from the directional antenna system.

* * * * *